US005190109A

United States Patent [19]

Pardo

[11] Patent Number: 5,190,109

[45] Date of Patent: Mar. 2, 1993

[54] METHOD AND APPARATUS FOR ISOLATING WELL BORES USING EXTERNAL PACKERS

[75] Inventor: Carlos W. Pardo, Missouri City, Tex.

[73] Assignee: Texaco Inc., White Plains, N.Y.

[21] Appl. No.: 770,815

[22] Filed: Oct. 4, 1991

[51] Int. Cl.[5] ..... E21B 33/127

[52] U.S. Cl. ..... 166/387; 166/187; 166/295

[58] Field of Search ..... 166/187, 295, 294, 285, 166/300, 387; 277/34, 34.6

[56] References Cited

U.S. PATENT DOCUMENTS

| | | | |
|---|---|---|---|
| 2,231,282 | 2/1941 | Norris | 166/187 X |
| 2,922,478 | 1/1960 | Maly | 166/187 X |
| 3,283,820 | 11/1966 | Tausch | 166/187 X |
| 4,378,843 | 4/1983 | Suman, Jr. | 166/187 X |
| 4,499,947 | 2/1985 | Zsoka et al. | 166/187 X |
| 4,633,946 | 1/1987 | Jackson | 166/187 |
| 4,674,570 | 6/1987 | Jackson | 166/187 |
| 4,714,117 | 12/1987 | Dech | 166/187 X |

*Primary Examiner*—Stephen J. Novosad
*Attorney, Agent, or Firm*—Jack H. Park; Kenneth R. Priem; Russell J. Egan

[57] ABSTRACT

An external packer assembly for isolating well bores has an inflatable member initially containing a catalyst or activator solution. An insertion assembly introduces a resin to the inflatable member which then inflates, under the influence of the expanding resin, into sealing engagement with the bore hole walls.

8 Claims, 2 Drawing Sheets

METHOD AND APPARATUS FOR ISOLATING WELL BORES USING EXTERNAL PACKERS

BACKGROUND OF THE INVENTION

1. The Field of the Invention

The present invention relates to a method and apparatus for selectively isolating portions of a well bore by use of a device known as a packer, and in particular, to a method and apparatus for expanding the packer in place.

2. The Prior Art

Many times, when completing wells, it is desirable to isolate specific zones which may be producing either gas or water, or some combination thereof, from a producing interval. One of the most commonly used methods for creating this isolation is by the use of external casing packers. These are assemblies which are inserted downhole and include an inflatable annular packing member. After the packer is properly positioned, the packing member is inflated outwardly to tightly engage the walls of the well bore thereby forming a seal. The known packers generally activated by injecting drilling fluid or cement into the inflatable packing member. The former system has the obvious drawback of requiring a constant pressure of drilling fluid to maintain the packing member inflated to the sealing condition. The latter system has the disadvantage that the cement may tend to shrink as it sets, and with age, resulting in at least partial deflation of the packing member and less than perfect seal.

The present invention intends to overcome the defects of the prior art by providing an improved external packer which is activated by a catalyst or activator solution and is inflated with a resin system that will consolidate when exposed to the catalyst.

SUMMARY OF THE INVENTION

The present invention concerns an external packer for well bore in which the inflatable member of the packer is expanded by introducing a resin to a catalyst or activator solution contained within the inflatable member, which member then expands to form a tight seal against the walls of the well bore.

BRIEF DESCRIPTION OF THE DRAWINGS

The present invention will now be described, by way of example, with reference to the accompanying drawings in which.

DETAILED DESCRIPTION OF THE PREFERRED EMBODIMENT

The well bore 10 is shown penetrating substrata 12,14, and 16. For the purposes of this illustration, strata 16 will be considered as one containing water or gas which is to be isolated from the rest of the well bore. This is usually accomplished by placing one or more packers in the well bore at or just outside the area to be sealed off.

Figure 1:
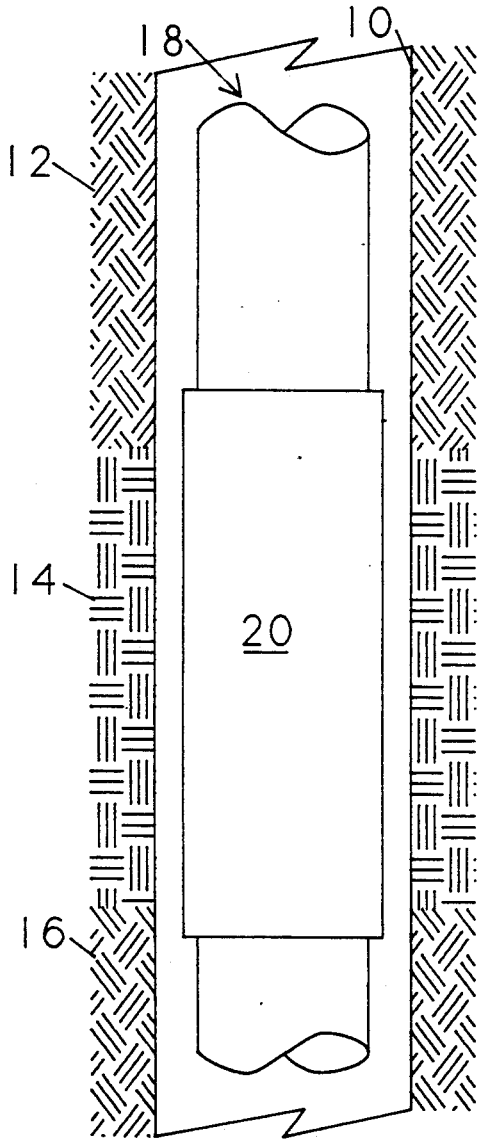
FIG. 1 is a diagrammatic vertical section through a portion of a well bore with the subject invention positioned for installation.
Figure 2:
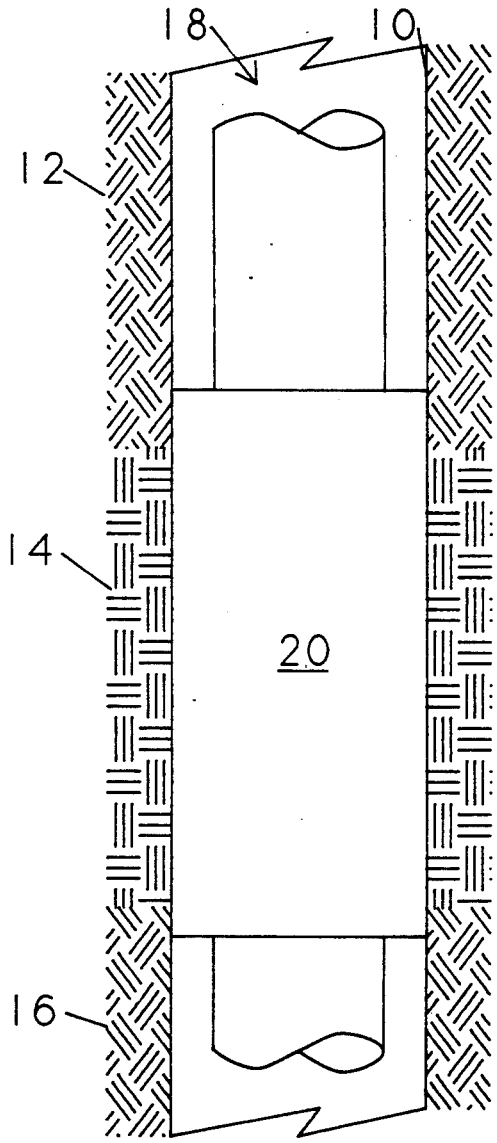
FIG. 2 is a view similar to FIG. 1 showing the subject invention in an inflated or installed condition.

The subject invention 18 has at least one inflatable external packer member 20. In FIG. 1 the inflatable packer member 20 is shown in an initial or retracted condition and in FIG. 2 it is shown in the inflated or sealing condition engaging the bore hole wall adjacent the strata 16 which is to be isolated.

It should be here noted that the present invention can be made to almost any size. Alternatively, it can be made in a series of individual segments to provide redundancy in the sealing achieved. The length and number of packer members would primarily be determined by well conditions, including but not restricted to the volume of water and/or gas flow and the pressures of such flow.

Figure 3:
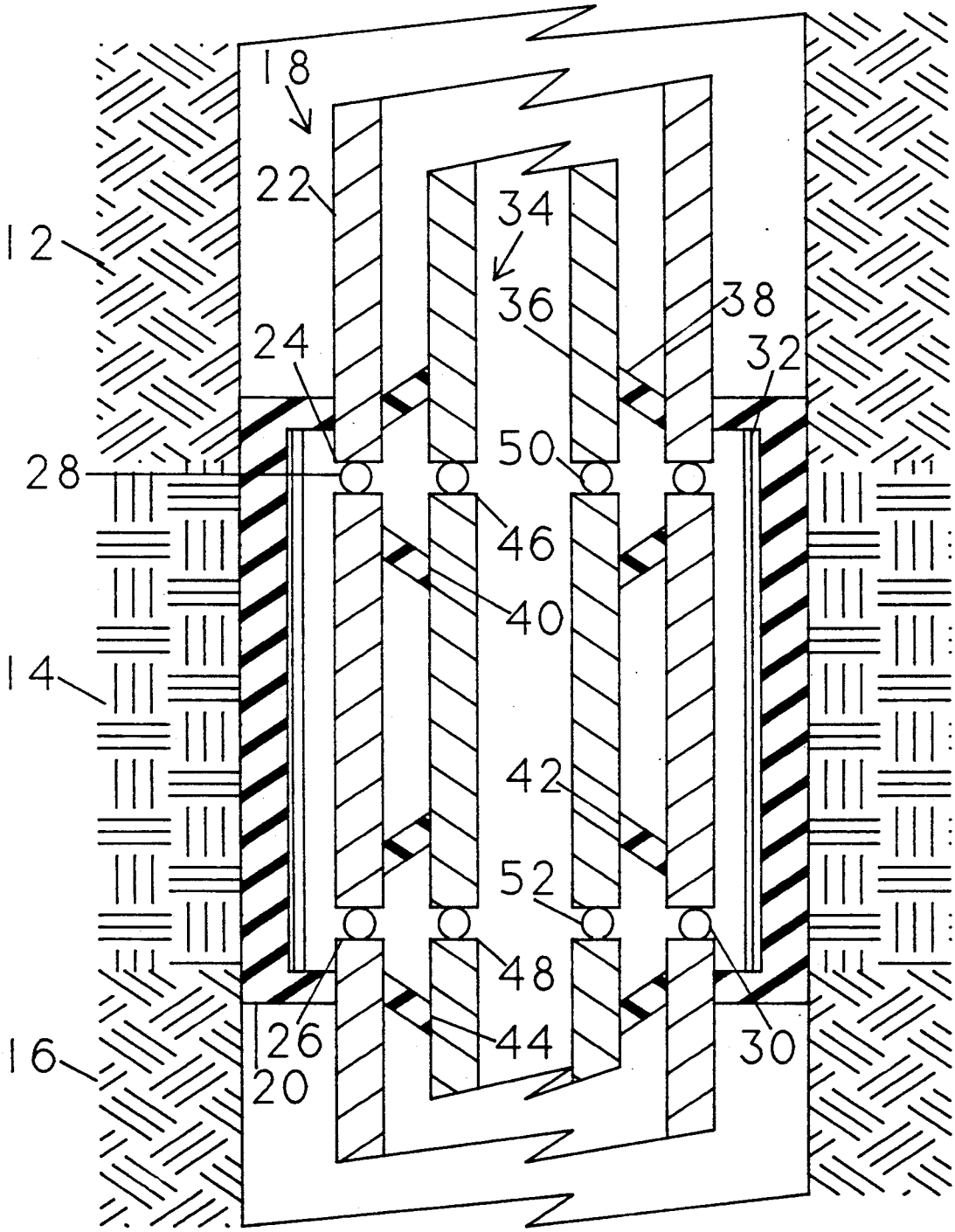
FIG. 3 is an enlarged diagrammatic vertical section through the subject invention showing the components thereof and its operation.

Turning now to FIG. 3, the subject invention 18 has a first pipe member 22 with the external annular inflatable packing member 20 mounted thereon in known fashion by conventional means (not shown). These means could include a variety of clamps and seals. The member 20 is in communication with the interior of the pipe member 22 by a series of communication openings 24,26 spaced about the periphery of pipe member 22. Each of these openings are provided, respectively, with one way check valve means 28,30. In the initial unexpanded condition of the inflatable packing member 20, a known amount of catalyst or activator solution is preferably evenly distributed about the periphery and the length of the packer member 20. This has been indicated by the layer 32 within the packing member 20. The activator could be placed within the inflatable packing member 20 by any one of a number of well known means, such as frangible vials (not shown).

An isolation or packer actuation tool 34 has a pipe member 3 which is received within pipe member 22 and is provided with a plurality of outwardly directed pairs of annular wiping sealing members 38,40,42,44 each pair isolating respective openings 46,48 spaced about the periphery of the pipe member. Each opening 46,48 can be provided with a valve or seal 50,52.

The isolation tool 34 is extended down the bore of the tool 18 to the area of the inflatable packing member 20 to be expanded and a resin (not shown) is injected through bore of the tool 34. The resin flows through openings 42,24,26 and the respective valve means 44,46,30 to mix with the catalyst or activator solution 32 carried within the inflatable packing member 20. The resulting resin system expands and consolidates in this expanded condition upon exposure to the catalyst. The initial pressure of the injection of the resin aids to inflate the packing member 20.

An example of suitable materials for use in this system would be the furan resin with an acid catalyst, such as toluene sulfonic acid.

The present invention will assure packer seal integrity for the life of the well. This will overcome the drawbacks of the prior art in that there is no requirement for constant pressure to keep the packer inflated nor will there be shrinkage of the packing ring with time. There is a further advantage of having the catalyst or activator in the packer in that there is little likelihood of the resin encountering anything which would cause it to activate until it reaches the packing member.

The present invention may be subject to many modifications and changes without departing from the spirit or essential characteristics thereof. The present embodiment should therefore be considered in all respects as illustrative and not restrictive as to the scope of the invention as defined by the appended claims.

I claim:

1. An improved external packer for well bores comprising:

a pipe member having at least one annular expandable packing member externally mounted thereon;

aperture means communicating between the interior of said pipe and the interior of each said at least one packing member;

isolation tool means to deliver a resin to each said respective at least one packing member; and activator means prepositioned within each said at least one packing member whereby introduction of said resin to each said respective at least one packing member causes said packing member to expand and consolidate with the packing member inflated tightly against the walls of said well bore.

2. The packer according to claim 1 wherein said activator means to activate said resin is a liquid contained within said packing member.

3. The packer according to claim 2 wherein said activator means is toluene sulfonic acid.

4. The packer according to claim 1 wherein said resin is a furan resin.

5. The packer according to claim 1 further comprising one way check valve means located within said aperture means, said valve means preventing escape of said activator means from said packing member.

6. A method for inflating an expandable sealing member of an external well bore packer comprising:

providing a pipe member with at least one annular external expandable packing member;

providing aperture means between said pipe member and each said at least one expandable packing member;

providing prepositioned within each said at least one expandable member a material which will activate a resin;

providing means to deliver resin to each said at least one expandable member; and delivering said resin to each said at least one expandable member whereby said resin will be expanded to inflate said member into sealing engagement with the well bore.

7. The method according to claim 6 wherein said activator material is toluene sulfonic acid.

8. The method according to claim 6 wherein said resin is a furan resin.

* * * * *